US005706709A

United States Patent [19]

Snow

[11] Patent Number: 5,706,709

[45] Date of Patent: Jan. 13, 1998

[54] OFFSET ROTARY TOOL

[76] Inventor: Wade Thomas Snow, 193 Delta Dr., Morristown, Tenn. 37814

[21] Appl. No.: 650,826

[22] Filed: May 20, 1996

[51] Int. Cl.[6] ..... B25B 13/00

[52] U.S. Cl. ..... 81/73; 81/177.1

[58] Field of Search ..... 81/28, 35, 37, 81/73, 177.1, 438

[56] References Cited

U.S. PATENT DOCUMENTS

| | | | |
|---|---|---|---|
| 460,256 | 9/1891 | Steward | 81/73 |
| 2,577,931 | 12/1951 | Tillman | 81/73 |
| 3,388,622 | 6/1968 | Klang | 81/73 X |
| 4,829,271 | 5/1989 | Kenigson | 81/177.1 |
| 4,924,733 | 5/1990 | McKenzie | 81/438 |
| 4,969,231 | 11/1990 | Mader et al. | 81/177.1 X |

FOREIGN PATENT DOCUMENTS

| | | | |
|---|---|---|---|
| 1363932 | 8/1974 | United Kingdom | 81/73 |

*Primary Examiner*—James G. Smith

*Attorney, Agent, or Firm*—Peter A. Borsari; Eric W. Trucksess

[57] ABSTRACT

The present invention provides a hand-powered tool facilitating the translation of rotary motion of a workman's arm through an angled shaft which may rotate freely with respect to a handle. The angled shaft has three coplanar bends resulting in a stretched "Z" configuration in order to allow the user to apply a great torque about a circle which his hand easily can describe and which is translated through the shaft to the subject fastener or surface point. The shaft is rotatably mounted to a handle through a bearing thereby enabling full rotation of the shaft with respect to the handle and permitting the user to complete a rotary cycle without release the tool. A hollow tip is disposed at one end of the tool within which interchangeable bits may be installed. An auxiliary handle releasably attached to the shaft also is provided for use in situations where a greater torque is required.

14 Claims, 2 Drawing Sheets

100
73
71
70
66
65
72
74
67
61
6
A
46
θ
45
4
44
48
ψ
φ
23
A
43
22
21
42
41
2
27
20
24
26
94
9
92
95

OFFSET ROTARY TOOL

FIELD OF INVENTION

The present invention relates to the field of hand-held and hand-powered tools, and more particularly to a hand-powered tool that translates rotary motion of a workman's hand to a fastener or surface point through an angled shaft which may rotate freely with respect to a handle. The shaft is bent at angles that allow the workman to apply a great torque about a circle which his hand can easily describe and which is translated through the shaft to the subject fastener or surface point. Free rotation of the shaft obviates the need of the workman to release the handle throughout an entire cycle of rotary movement. An auxiliary handle may be attached to the shaft to generate an even greater torque through the tip of the shaft.

BACKGROUND OF THE INVENTION

When screwing or unscrewing a fastener contacting a surface, a workman's efficiency is limited by the ability of the tool to translate the mechanical force exerted by his hand to the fastener through rotary movement. Other tasks requiring the same mechanical translation include manual drilling, threading and the like. Tools which perform these tasks through the use of a fixed handle mounted to a straight shaft impose a physical limitation on the workman, allowing him to utilize only the torque which he can exert through his hand by the twisting of his wrist using the arm muscles. Additionally, because the wrist cannot rotate completely about a circle, to complete a cycle of rotation with a conventional manual tool, the workman must periodically release his grip on the handle of the tool, rotate his hand back to a starting position and re-grip the tool handle to continue applying force.

The remonstration to use "the right tool for the right job" indicates that different tasks may require the use of different tools; however, the accumulation of numerous tools all of which are designed to translate the workman's exertions to a rotary force at a particular point is inefficient and may be expensive.

Attempts have been made to provide rotary tools permitting better translation of the workman's exertions to a particular point. For example, U.S. Pat. No. 4,947,477, issued Dec. 4, 1990 to A. D. Anderson discloses a wrench having a bent shaft and a freely rotating handle which turns on a ball bearing. Different tool bits may be attached to the shaft by a bayonet mount system. The shaft is bent into an S having a first angle of about 40° and a second angle of about 55°. The circular motion of the handle is in the pattern of a cone, with the peak of the cone occurring at the intersection of the shaft axis and the handle axis within the middle of the handle. Although full rotation of the wrist is permitted, because the peak of the cone occurs so far within the handle grasped by the hand, the shoulder and back muscles may not be effectively utilized in assisting the wrist and hand to turn this tool.

U.S. Pat. No. 5,349,886, issued Sep. 27, 1994 to S. W. Jin discloses a hand tool including a freely rotatable handle and a bent shaft having an end recess which selectively bears against one of two conical protrusions within the handle. As with the Anderson tool, circular motion of the handle of the Jin tool describes a cone. Selection of a particular conical protrusion determines the height above the handle at which the cone's peak will be defined. In both of the illustrated positions, although Jin's tool permits the workman to more effectively use his shoulder and back muscles, a wobble can be expected at the end at which the tool contacts a fastener caused by the inability of the workman to evenly rotate the handle. This tool ostensibly prevents the twisting of the workman's wrist, thereby preventing him from using the fine movements produced by wrist movement to control the movement of the tool handle. Neither the Anderson tool nor the Jin tool include an auxiliary handle that permits the workman to exert great torques at the tool heads.

U.S. Pat. No. 1,752,703, issued Apr. 1, 1930 to H. E. Simson discloses a screw driver having a bent shaft terminating in a peened flange which contacts a pin having a rounded head to permit free rotation of the handle about the shaft. Again, a wobble may be expected in the use of this tool, and no auxiliary handle is present.

U.S. Pat. No. 460,256, issued Sep. 29, 1891 to J. F. Steward; U.S. Pat. No. 684,722, issued Oct. 15, 1981 to E. S. Rose; U.S. Pat. No. 1,642,569, issued Sep. 13, 1927 to F. H. Winslow et al. and U.S. Pat. No. 872,048, issued Nov. 26, 1907 to W. Broad disclose hand tools including bent shaft portions and rotating handles having multiple rotating sections.

U.S. Pat. No. 2,476,364, issued Jul. 17, 1946 to W. H. Gaines and U.S. Pat. No. 2,675,840, issued Apr. 20, 1954 to O. C. Daiber disclose brace-type tools which include leverage increasing extension levers.

U.S. Pat. No. 512,384, issued Jan. 9, 1894 to D. W. Meacham is representative of tools including holes for receiving leverage increasing devices such as hand levers into holes.

Despite the teachings of the prior art, a need still exists for a hand-powered tool which facilitates the translation of rotary motion of a workman's hand to a fastener or surface contact point through a freely rotating angled shaft. Such an angled shaft should translate a great torque from the exertions of the workman's upper body muscles to a surface contact point or fastener throughout the range of movement and without wobbling of the tool. Such a shaft also should be rotatable without requiring the release of the tool by the workman. Additionally, such a tool should be equipped with an auxiliary handle to permit the application of an even greater torque to a surface contact point or fastener when deemed necessary by the user.

SUMMARY OF THE INVENTION

Accordingly, it is an object of the present invention to provide a hand-powered rotary tool in which the aforementioned problems can be overcome and which comprises a handle which rotatably receives a first end of an angled shaft through a bearing and a recess within a second end of the shaft for receiving a tool bit thereby permitting continuous facilitated rotation about a fastener or surface point.

It is another object of the present invention to provide a hand-powered rotary tool in which the interchangeability of tool bits permits the tool to perform multiple functions.

It is an additional object of the present invention to provide a hand-powered rotary tool to which an auxiliary handle may be attached to exert an even greater translated force than that which can be exerted through the rotating handle to a fastener or surface point.

It is a still further object of the present invention to provide a hand-powered rotary tool which is economical to manufacture, durable in construction and effective in operation.

Additional objects, advantages and novel features of the present invention will be set forth in part in the description which follows and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

BRIEF DESCRIPTION OF THE DRAWINGS

The present invention will be better understood with reference to the appended drawing sheets, wherein.

DETAILED DESCRIPTION

It will be appreciated that the present invention can take many forms and embodiments. Some embodiments of the invention are described so as to give an understanding of the invention. It is not intended that the illustrative embodiments described herein should limit the invention.

Figure 1:
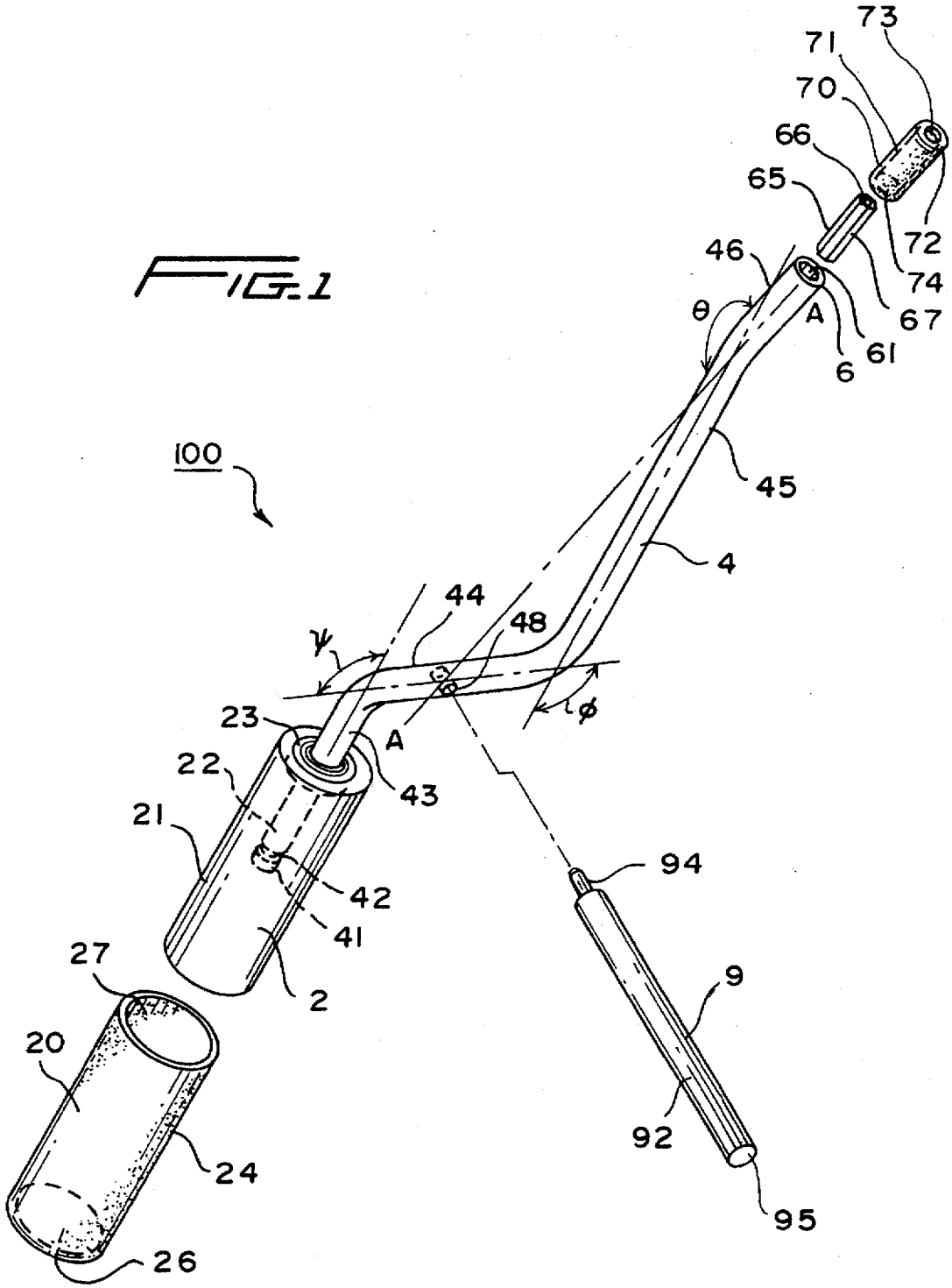
FIG. 1 is an exploded side perspective view of the offset rotary tool of the present invention.

Referring to the drawings, in particular FIG. 1, there is shown an offset rotary tool 100 of the present invention consisting essentially of a handle 2, a bearing 8 secured thereto, an angled shaft 4 rotatably fixed to said handle through said bearing and having a hollow tip 6. Handle 2 comprises a solid cylindrical body 21 having a first cylindrical recess 22 and a second cylindrical recess 23. Handle 2 may be manufactured from any suitably durable material well known in the art including, for example, metal, wood, hardened rubber or hardened, high-impact plastic. A hollow handle cover 20 comprising a side wall 24, a top wall 26 and a cavity 27 defined thereby may be fitted to the handle 2. Although shown having a smooth side wall 24, handle cover 20 may be manufactured with rounded flutes disposed longitudinally about its circumference as are commonly found on tool handles. Suitable construction materials for handle cover 20 include flexible rubbers and plastics which may be textured or smooth to promote an optimal grip by a user.

Examining angled shaft 4 in detail shows that the shaft comprises a rod having a first or proximal end 41 and a second or distal end 46. At the proximal end 41 of shaft 4, the rod is narrowed and is configured with a groove 42 about its circumference for engaging a bearing 8 disposed in a first cylindrical recess 22 of handle 2. The remainder of the angled shaft 4 is of uniform thickness, terminating in distal end 46 fashioned with a hollow tip 6 having a recess 61. Angled shaft 4 contains three coplanar bends resulting in a four segments or sections. More specifically, shaft 4 comprises a first straight section 43, a first bend $\omega$ (psi), a second straight section 44 having a shaft hole 48, a second bend $\phi$ (phi), a third straight section 45 a third bend $\theta$ (theta) and a fourth section denoted as the distal end 46. All three bends occur along angled shaft 4 within a common plane so that the angled shaft is planar and the hollow tip 6 points outwardly with respect to handle 2.

The first bend $\omega$ is a 100° angle from the longitudinal axis of section 43; the second bend $\phi$ is a 105° angle from the longitudinal axis of section 44, the second bend bending in a direction opposite from that of the first ben; the third bend $\theta$ is a 165° angle from the longitudinal axis of section 45, the third bend being a direction opposite to that of the second bend in such manner that if a line A—A were drawn connecting the hollow tip 6 and shaft hole 48, then the second end 46 would lie along this line. Angled shaft 4 may be made from any material well known in the prior art. Preferably, the angled shaft is made of a metal such as steel and may be zinc plated for durability.

The recess 61 of the hollow tip 6 of shaft 4 is shown to have a hexagonal shape for use with similarly sized hex-head bits. However, it is to be understood that the recess 61 may be configured to engage other sized bits if desired. To accommodate different sized screw heads, an interchangeable bit 65 having a hexagonal prism body 67 is introduced into recess 61. Although as illustrated, the bit 65 is suitable for use with hexshaped screw heads, other bit configurations may be chosen, including for example, a flat screwdriver head, a Phillips screwdriver head and the like. Additionally, bits 65 can be designed to provide tool heads of other standard tools that utilize rotary movement such as drills, augers and the like. A cap 70 comprising a cylindrical side wall 71, a circular bottom wall 72 having an opening 73 and a cylindrical cavity 74 defined thereby fits over tip 6 to ensure that the bit is secured retained within the tool 100. The cap 70 may be manufactured from a resilient material such as plastic or rubber.

Figure 2:
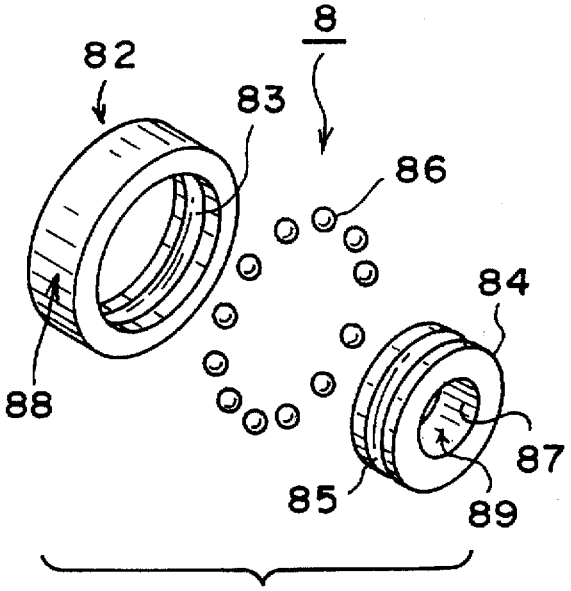
FIG. 2 is an exploded side perspective view of the bearing of the offset rotary tool of the present invention.

As best seen in FIG. 2, the handle 2 comprises a metal bearing 8 having a first annular member 82 configured with an interior groove 83, a smaller second annular member 84 having an exterior groove 85 and a plurality of metal spherical members 86. Each of the spherical members 86 are identical in size and fit between first annular member 82 and second annular member 84 within their respective grooves 83 and 85. The radius of the exterior wall 88 of the first annular member 82 closely approximates the radius of the second cylindrical recess 23 wherein the bearing 8 is fixedly housed. The radius of the interior wall 87 of the second annular member closely approximates that of the proximal end 41 of the shaft 4 which is introduced through the bearing 8 at bearing hole 89. In this manner, proximal end 41 of the shaft 4 is fixedly mounted to the second annular member 84, resulting in the free rotation of the shaft 4 with respect to the handle 2 through the spherical members 86. Preferably, a durable metal is employed as the construction material for the bearing 8 elements; more preferably, both the interior groove 83 and the exterior groove 85 are coated with a smooth substance such as Teflon™ to provide a smooth surface upon which the spherical members 86 can roll. However, the bearing 8 elements can be made from any suitable material well known to practitioners in the prior art.

An auxiliary handle 9 comprises a rod 92 having a first end 95 and a second, narrowed end 94 whose radius closely approximates that of shaft hole 48. When auxiliary handle 9 is attached to shaft 4 by insertion of second end 94 into shaft hole 48, first end 95 projects from the plane of the shaft at a right angle. The handle 9 can be constructed from any suitably durable material, including, for example, metal, wood and the like.

The offset rotary tool 100 of the present invention is used in the manner of conventional rotary hand tools to exert either a torque to a fastener or a rotating cutting surface to a defined point. The workman selects and inserts a bit 65 into recess 61 and positions cap 70 over the shaft tip 6, thereby securely retaining the bit 65 within the recess 61. The bit 65 may be used to engage a fastener or a surface point about which the shaft 4 may be rotated by applying rotary motion to the handle 2. Because the handle 2 is offset from the distal end 46 of the shaft 4 containing the bit 65, the workman's motion will proceed about a circle having a radius $r_1$ greater than that of the shaft ($r_2$), exerting a torque, T (tau) related to the equation: T=F×r, where F is the applied force, r is radius of the described circle and x indicates a cross product. The differential between $r_1$ and $r_2$ implies that the workman can exert a torque translated through the bit 65 greater by a factor equal to this differential than that which he would be able to if the handle 2 were not offset.

The offset of the handle 2 allows the workman to use a cranking motion of his entire arm rather than of just his wrist, better utilizing the muscles of his shoulder and back as well as those of the upper arm. Throughout a cycle of rotary movement, the handle 2 will describe a frusto-conical section of a cone having an apex toward the top of the handle. Because of the positioning of this apex, the movement of the handle is primarily enabled by movement of the entire forearm which may describe a large circle above the tool 100. However, additional exertions by the wrist give the workman control over the rotation of the handle 2. It has been determined empirically that the third bend θ helps to stabilize the shaft tip 6 by forcing the shaft 4 to rotate above the defined point in a nearly vertical attitude while allowing the workman's hand and arm to comfortably rotate. Finally, by allowing a free rotation of the shaft 4 with respect to the handle 2, the bearing 8 obviates the need of the workman to release the handle throughout the entire cycle of rotary movement.

Figure 3:
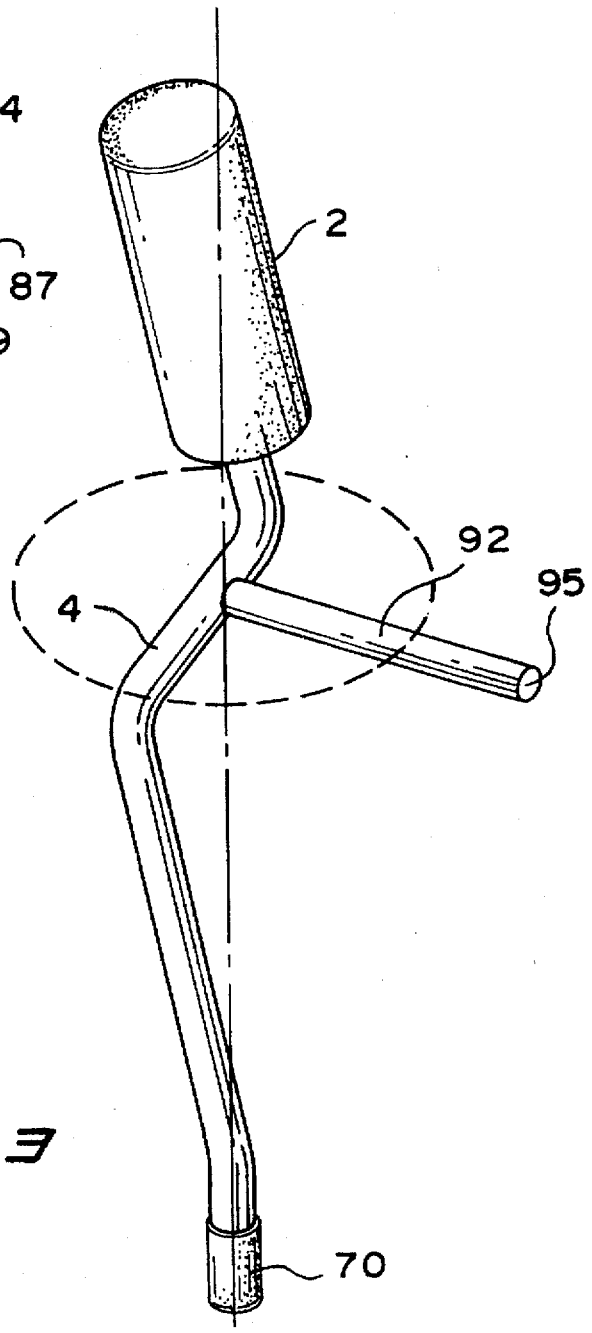
FIG. 3 is a top view of the assembled offset rotary tool of the present invention showing an auxiliary handle.

In instances where an even greater torque must be applied to a fastener or point, the auxiliary handle 9 is used by inserting the narrowed end 94 into shaft hole 48. As can be seen in FIG. 3, the auxiliary handle 9 projects outwardly from the shaft and when rotated describes a circle having a radius even larger than that described by the handle alone. By the same elementary principle discussed above, the use of the auxiliary handle 9 allows the workman to apply an even greater torque through the bit than when using handle 2, although he must release the auxiliary handle to complete the rotary movement.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. An offset rotary tool comprising:

(a) a handle;

(b) a bearing fixedly mounted within said handle;

(c) an angled shaft having a first proximal end rotatably mounted to said handle through said bearing and a second distal end having a working tip, said angled shaft having three coplanar bends and comprising a first segment, a first bend of about 100° proximal to said first segment of said angled shaft and defining a second segment, a second bend of about 105° in the direction opposite from said first bend and defining a third segment and a third bend of about 165° proximal to said second end of said shaft in a direction opposite to that of said second bend and defining a fourth segment and (d) an aperture disposed at the approximate center of said second segment; whereby if a reference line were drawn connecting said aperture with said working tip, said second distal end would lie along this line.

2. An offset rotary tool according to claim 1, further comprising a handle cover having a side wall and a top wall, said side wall and top wall being integrally constructed and defining a cavity configured to cover said handle.

3. An offset rotary tool according to claim 2, wherein said handle cover is constructed from smooth flexible rubber, smooth flexible plastic, textured flexible rubber or textured flexible plastic.

4. An offset rotary tool according to claim 2, wherein said handle cover further comprises rounded flutes disposed longitudinally about the circumference of said side wall.

5. An offset rotary tool according to claim 1, wherein said handle is constructed from metal, wood, hardened rubber or hardened, high-impact plastic.

6. An offset rotary tool according to claim 1, wherein said bearing comprises:

a first annular member having an interior groove;

a second annular member having a radius less than that of said first annular member and having an exterior groove;

a plurality of spherical members, each of said spherical members having a radius equal to the difference in the radii of said first and second annular members and being situated within said exterior groove of said second annular member and within said interior groove of said first annular member, whereby said first annular member is may rotate freely over said spherical members about said second annular member and whereby said first end of said angled shaft penetrates through said hole of said second annular member.

7. An offset rotary tool according to claim 6, wherein said first and said second annular members are metal.

8. An offset rotary tool according to claim 7, wherein said interior groove of said first annular member and said exterior groove of said second annular member are coated with Teflon™.

9. An offset rotary tool according to claim 5, wherein said spherical members are metal.

10. An offset rotary tool according to claim 9, wherein said angled shaft is constructed from metal or zinc plated metal.

11. An offset rotary tool according to claim 1, wherein said second distal end comprises a hollow tip having a recess defined therein.

12. An offset rotary tool according to claim 11, wherein said recess configured to receive an interchangeable tool bit.

13. An offset rotary tool according to claim 1, further comprising a cap having a cylindrical side wall integral with a circular bottom wall having an opening therein, said side wall and said bottom wall defining a cylindrical cavity configured to receive said distal end of said angled shaft in order to securely retain said interchangeable tool bit within said recess.

14. An offset rotary tool according to claim 1, further comprising an auxiliary handle in the form of a rod having a first end releasably insertable in said aperture and a second distal end extending outwardly therefrom.

* * * * *